US005272849A

United States Patent [19]

Zahner, III

[11] Patent Number: 5,272,849

[45] Date of Patent: Dec. 28, 1993

[54] ROOF COVERING SYSTEM

[75] Inventor: L. William Zahner, III, Kansas City, Mo.

[73] Assignee: A. Zahner Sheet Metal Company, Kansas City, Mo.

[21] Appl. No.: 722,313

[22] Filed: Jun. 27, 1991

[51] Int. Cl.[5] ..... E04C 1/34

[52] U.S. Cl. ..... 52/466

[58] Field of Search ..... 52/459, 461, 465, 469, 52/466, 478, 278, 573

[56] References Cited

U.S. PATENT DOCUMENTS

| | | | |
|---|---|---|---|
| 1,240,773 | 9/1927 | Perry | 52/466 |
| 2,408,557 | 10/1946 | Huntington | 52/466 |
| 2,574,937 | 11/1951 | Sampson | 52/466 |
| 3,212,223 | 10/1965 | Blok | 52/478 |
| 4,400,924 | 8/1983 | Andrews | 52/466 |
| 4,590,730 | 5/1986 | Blendick | 52/461 |

FOREIGN PATENT DOCUMENTS

| | | | |
|---|---|---|---|
| 209725 | 2/1956 | Australia | 52/466 |
| 1161050 | 3/1958 | France | 52/466 |

*Primary Examiner*—James L. Ridgill, Jr.

*Attorney, Agent, or Firm*—Hovey, Williams, Timmons & Collins

[57] ABSTRACT

An improved roof covering system (10) includes roof panels (12), joint areas (14), joint covers (16), and securing assemblies (18). The joint covers (16) include transversely extending locking tabs (40). The securing assembly includes clips (36) having vertically oriented slots (38) for engaging the tabs (40). The cover (16) is thereby secured over the joint (14) in weathertight relationship without the use of exposed fasteners while preventing longitudinal movement between the joints (14) and covers (16).

11 Claims, 2 Drawing Sheets

ROOF COVERING SYSTEM

BACKGROUND OF THE INVENTION

1. Field of the Invention

The present invention is broadly concerned with an improved roof covering system. More particularly it is concerned with a system securing joint covers to the joint areas of adjacent roof panels in a weathertight relationship without the use of exposed fasteners while preventing longitudinal movement between the joints and covers.

2. Description of the Prior Art

Prior art metal roof panel attachment systems typically include a plurality of sheet metal panels mounted in overlapping relationship and having adjacent longitudinal margins with a joint area therebetween. Thermal expansion and contraction of the panels permit water, snow or ice to enter any exposed, unprotected joint areas, seep beneath the panels, and eventually cause damage to the underlying roof structure. Points where the panels are fastened to the roof structure also present areas vulnerable to moisture entry and consequent damage.

Previous systems have addressed these problems by fastening the panels to the roof with a bracket or batten structure mounted within the joint area and providing a cover which extends over the longitudinal margins of the adjacent panels and the interjacent joint areas. Such previous systems employ joint covers which are held in place by friction fit of the cover and battens and thus are free to expand and contract longitudinally in response to changes in the ambient temperature.

However, the absence of a securing point on each cover section limits the number of cover sections that can be safely employed in a single run to provide a roof having sufficient strength and uplift rating. On large areas where two or more cover sections are joined end-to-end, movement from thermal expansion and contraction can cause the sections to work apart at the end seams unless an exposed fastener is employed. The strength of such roof panel attachment systems is not uniform as the securing forces are focused on individual fasteners. Expansion and contraction forces are likewise focused on these fasteners, which must bend to absorb thermal movement of the roof system.

Other prior attachment systems have employed wood as a batten support. Since the configuration of the available wood stocks is rectilinear, the joint cover design in such systems is limited to a specific rectangular or trapezoidal geometry determined by the shape of the stock. The use of curved forms is effectively precluded. In addition, where rectilinear forms are employed, crimping machinery is required at the job site.

SUMMARY OF THE INVENTION

The present invention overcomes the problems outlined above and provides a greatly improved roof covering system having structural features which permit coupling and securing of multiple joint cover sections without the use of an exposed fastener while controlling longitudinal thermal movement of the cover sections relative to the joint. Broadly speaking the roof covering system includes a plurality of roof panels disposed in side-by-side relationship with joints in between, a joint cover, and a securing assembly for securing the cover over the joint area and for preventing relative longitudinal movement between the joint and cover.

In particularly preferred forms, the cover section includes transversely extending locking tabs. In such forms the securing assembly includes clips having vertically oriented slots for engaging the tabs and thereby preventing relative longitudinal movement. In still other preferred forms, the locking tabs are disposed in the vicinity of one of the ends of the cover to permit interfitting of a portion of the untabbed end of the cover over an adjacent cover.

DESCRIPTION OF THE PREFERRED EMBODIMENT

Figures 1, 2, 3:
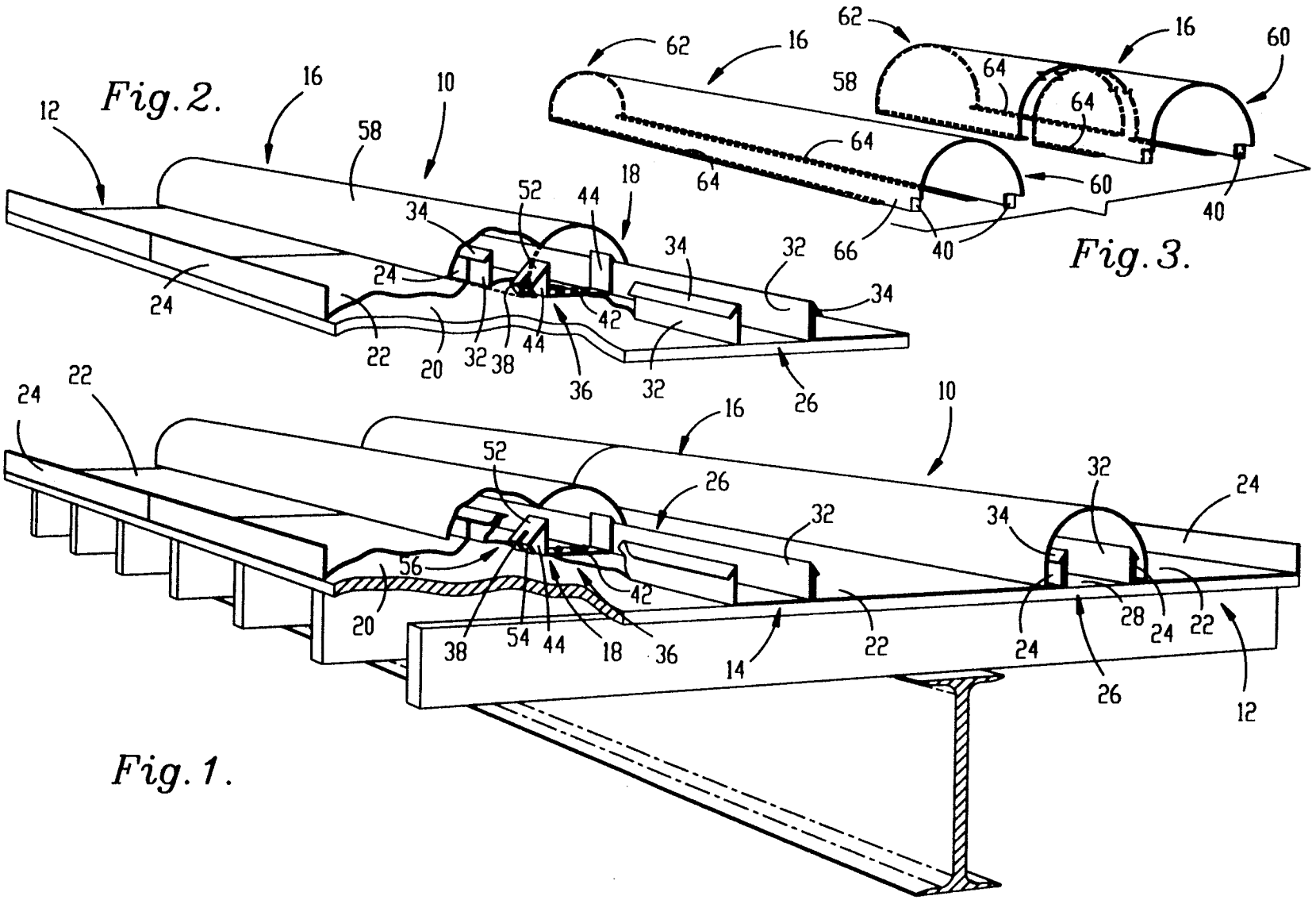
FIG. 1 is a fragmentary perspective view of a metal roof panel attachment system in accordance with the invention in place on a roof, with parts broken away to show the joint area.
FIG. 2 is a fragmentary perspective view of the roof panel and joint cover of the attachment system described in FIG. 1, with parts in phantom showing the locking tabs engaged in the clip slots.
FIG. 3 is a perspective view showing the joint covers described in FIG. 1.

Turning now to the drawings, a roof covering system 10 in accordance with the invention is shown in FIGS. 1 and 2 and includes elongated, generally rectangular roof panels 12 disposed in side-by-side relationship with interposed joint areas 14, a joint cover 16, and a securing assembly 18 for securing a joint cover 16 in a covering relationship to joint area 14. In the preferred embodiment, system 10 is employed for the attachment of metal panels to an underlying roof structure 20. However, the invention is not limited to such applications and could be employed to attach panels of other materials such as synthetic resin to a roof or as siding to the outer walls of a structure.

In more detail, roof panels 12 include a planar portion 22 having the longitudinal margins integrally formed into upstanding flanges 24. In particularly preferred forms panels 12 are at least about 9 inches (22.86 cm) in width and of any suitable length. The preferred flanges 22 extend in generally perpendicular relationship to planar portion 22 for about 1 inch (2.54 centimeters) in roof applications and about ½ inches (1.27 cm) for walls.

Joint areas 14 are located between adjacent roof panels 12, and include a cheat 26 having an elongated planar bottom portion 28 with laterally spaced pairs of apertures 30 at intervals to permit fastening along the cleat 26. The longitudinal margins of cleat 26 are formed into integral upstanding flanges 32, each having an angled portion 34 extending outwardly and downwardly. The preferred cleat bottom portion 28 measures about ¾ inches (1.905 cm) by about 10 feet (3.048 meters) with pairs of prepunched apertures at intervals of about 18 inches (45.72 cm). The preferred flanges have a height of about 2 ⅛ inches (5.4 cm).

Securing assembly 18 includes a batten clip 36 having slots 38 and interlocking tabs 40 which are integrally formed as part of joint cover 16. Batten clip 36 includes a generally planar bottom portion 42 and upstanding flanges 44 along the transverse margins. Bottom portion 42 presents a pair of apertures 46 laterally spaced for alignment with similar apertures 30 in cleat 24. Fasteners 48 pass through sealing washers 50 and thence through apertures 30, 46 to join clip 36 to cleat 26 in a weathertight connection. Both sets of apertures 30, 46 are oversized with respect to fasteners 48 which extend therethrough in order to allow for controlled thermal expansion. Such construction permits use of any of a large range of fastener materials having different thermal expansion coefficients.

Each flange 44 includes a first angled portion 52 extending outwardly and downwardly, coupled with a second angled portion 54 extending downwardly and back inwardly toward the respective clip flange 44. At their juncture, angled portions 52, 54 cooperatively form a transverse surface 56 for frictional engagement of joint cover 16. Each pair of angled flanges 52, 54 presents a vertically oriented slot 38 which interrupts surface 56 for receipt of locking tabs 40 which extend inwardly into slots 38 from joint cover 16.

Figures 4, 5:
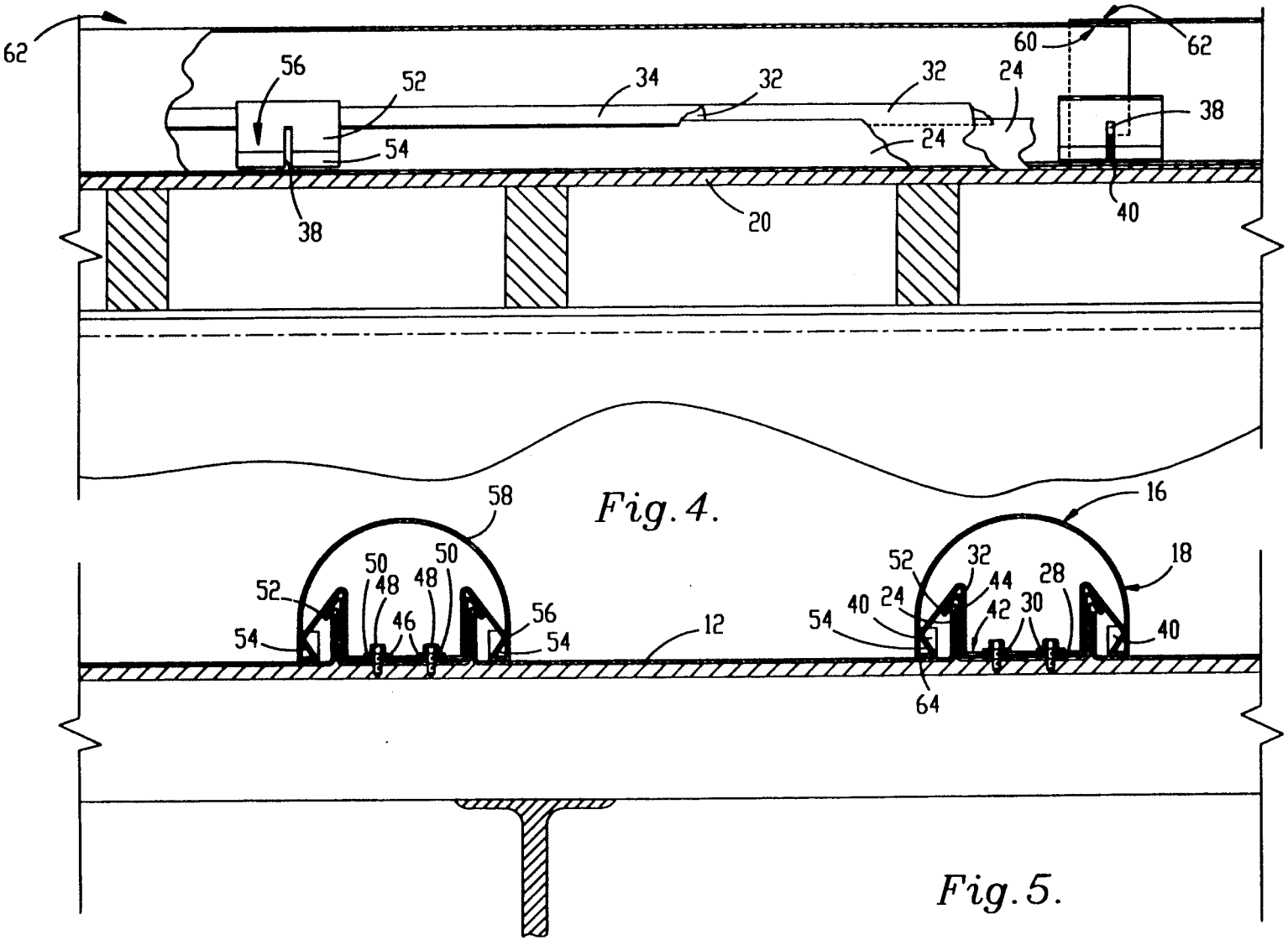
FIG. 4 is a fragmentary longitudinal sectional view of the attachment system described in FIG. 1 with parts broken away.
FIG. 5 is a vertical cross section of the attachment system described in FIG. 1.

As best shown in FIGS. 3–5, joint cover 16 includes a generally C-shaped, elongate arcuate cap portion 58 presenting a pair of ends 60, 62. Locking tabs 40 extend inwardly in the vicinity of tab end 60. Flanges 64 extend inwardly along the longitudinal margins of cap 58, terminating at a point approaching tab end 60 to leave an unflanged cap section 66.

In other preferred embodiments, cap portion 58 may be constructed in any aesthetically pleasing configuration, such as squared, rectangular, ogive, trefoil, or other custom geometric design. In such embodiments angled flange portions 52, 54 are appropriately configured to provide frictional contact between transverse surface 56 and cap 58.

The preferred roof panels 12, cleats 26, clips 36, and joint covers 16 are constructed of sheet metal such as stainless steel, prefinished galvanized steel, aluminum, copper, brass, or any other suitable material including synthetic resin. The cleats 26, clips 36 and joint covers 16 are preferably constructed of the same material as roof panels 12 to eliminate corrosion between dissimilar materials and concomitant weakening. Roof panels 12, cleats 26, and joint covers 16 are preferably constructed of up to 10 gauge material (0.125 inches; 0.32 cm), while the clips 36 may be of 12 to 28 gauge material, with 16–24 gauge being preferred. Washers 50 are preferably formed of synthetic resin such as neoprene or other material having similar flexibility and sealing ability.

In use, roof panels 12 are installed on a roof structure 20 in overlapping manner in a staggered arrangement. Cleats 26 are likewise installed end-over-end in overlapping manner in joint area 14 between adjacent panels 12. Cleat flanges 32 abut upstanding panel flanges 24 with angled portion 34 overhanging the panel flanges. Cleats 26 are secured in place by fasteners 48 which extend through washers 50, clip apertures 46, cleat apertures 30 and thence into roof structure 20.

When fastened to roof structure 20 in this manner, the cleats 26 form a continuous system for applying even pressure to roof panels 12 while permitting thermal expansion. In this manner the "oil-can" and "fish-eye" effects caused by other spaced clip restraint systems are eliminated. Panel wear from excessive pressures generated by thermal expansion and contraction is reduced as well. At the same time, a holddown system of superior strength is achieved, because cleat 26 extends the entire length of the roof panel, permitting a reduction in the gauge of cleat 26 without a loss in strength. The uplift rating of the resulting roof is higher because the load bearing areas are distributed along the length of the roof panel 12 rather than focused on individual clips 36.

Once panels 12 are secured by cleats 26 and clips 36, roof covering system 10 is watertight. Joint cover 16 can be installed at a later date if it is more convenient to do so. In other embodiments, shorter cleats 26 may be employed at intervals rather than continuously to hold down panels 12, resulting in material savings. In such embodiments it is desirable to install joint cover 16 immediately to effect a completely weatherproof joint 14.

As best shown in FIGS. 3 and 4, a joint cover 16 is installed in covering relationship to joint area 14 by positioning the cap portion 58 over cleats 26, sliding or snapping flanges 64 under the lowermost ends of second angled portions 54 of batten clips 36, and engaging tabs 40 in clip slots 38. Subsequent joint covers 16 are installed in overlapping manner by sliding or snapping the flanged telescoping end 62 over the unflanged section 66 of an installed joint cover section 16, thus enhancing the engagement of its locking tabs 40. Since each joint cover 16 is anchored by tabs 40 at one end only, thermal expansion and contraction can occur on any part of the cover 16. The securing assembly 18 is designed to allow for thermal expansion, which can even take place within the fit of tabs 40 in slots 38.

Thus installed, joint cover 16 presents a pair of continuous lower flanges 64 which are constrained downwardly towards the surface of roof panels 12 by second angled clip flange portions 54. Transverse movement of joint cover 16 is impeded by frictional engagement of clip flange surface 56 against the inner surface of the cover. Joint cover 16 is anchored against longitudinal movement within joint area 14 by engagement of locking tabs 40 within slots 38.

In this manner, the continuous cleat 26, joint cover 16 and securing assembly 18 cooperatively provide a roof panel attachment system 10 with a higher uplift rating and enhanced resistance to damage from high winds and provide a positive mechanical lock which prevents longitudinal movement of joint cover 16 to ensure maintenance of the weathertight seal over joint area 14.

The novel seam design of the roof covering system of the present invention permits securing of joint cover 16 at individual points without requiring the use of an exposed fastener while permitting use of a joint cover 16 formed in custom geometric shapes as well as the traditional rectilinear forms. Moreover, the system provides for convenient installation. Since the roof panel attachment system 10 is watertight even without the joint cover 16, the cover may be installed at a later date. This feature advantageously permits work crews to install roof panels 12 and securing assemblies 18, which form a weatherproof covering with maximum speed in the face of impending inclement weather conditions, and return at a later time to install joint covers 16 without compromising the weatherproof character of the roof covering system. Installation is simple and no specialized crimping tools or equipment are required at the job site.

I claim:

1. An apparatus for covering a roof comprising:

a plurality of roof panels with adjacent ones thereof presenting an elongated joint therebetween;

an elongated, channel-shaped, cleat extending the entire length of said joint between said roof panel flanges;

an elongated, concavo-convex, downwardly opening, joint cover having opposed side walls with respective interior surfaces; and cover attachment means, including means for securing to the roof, for holding said cover in a superposed, covering relationship with said joint and for preventing longitudinal shifting of said cover relative to the roof, said attachment means including slot walls defining a pair of elongated, upright, tab-receiving slots located on opposed sides of said joint with each slot opening outwardly in a transverse direction relative thereto, and a pair of upright tabs extending inwardly and transverse to said respective side wall interior surfaces of said cover and configured for reception in said respective slots.

2. The apparatus as set forth in claim 1, said cover presenting first and second ends with said tabs extending inwardly from said first end with said second end being free of said tabs for allowing thermal expansion of said cover relative to said first end.

3. The apparatus as set forth in claim 1, said cover presenting first and second ends with said tabs extending inwardly from said first end with said second end being free of said tabs for allowing overlap of said second end with the first end of another of said covers longitudinally aligned therewith.

4. The apparatus as set forth in claim 1, said cleat presenting opposed, upstanding cleat flanges adjacent a respective roof panel flange with each cleat flange having an angled portion extending outwardly over the adjacent roof panel flange.

5. The apparatus as set forth in claim 1, said cover including a pair of cover flanges extending inwardly from said respective side wall interior surfaces and extending parallel to the roof, said attachment means including means for engaging said cover flanges and for preventing upwardly shifting of said cover.

6. The apparatus as set forth in claim 1, said cover presenting a C-shaped configuration.

7. The apparatus as set forth in claim 1, said attachment means including a batten clip, including means for coupling with the roof, extending across and transverse to said joint, said clip presenting opposed ends with said ends respectively presenting said slots.

8. The apparatus as set forth in claim 7, said cover including a pair of cover flanges extending inwardly from said respective side wall interior surfaces and extending parallel to the roof, each of said cover flanges presenting an upper face, said clip ends each including structure for engaging a respective upper face for preventing upward shifting of said cover.

9. An apparatus for covering a roof comprising:

a plurality of roof panels with adjacent ones thereof presenting an elongated joint therebetween;

an elongated, channel-shaped cleat extending the entire length of said joint between said roof panel flanges;

an elongated, concavo-convex, downwardly opening, joint cover having opposed side walls with respective interior surfaces, said cover presenting first end and a second end and including a pair of upright tabs, adjacent said one end, and extending inwardly from said respective interior surfaces toward and transverse to said joint; and a batten clip, including means for coupling with the roof, presenting opposed ends located on opposed sides of said joint, each end including slot walls defining an elongated, upright, tab receiving slot opening outwardly in a transverse direction relative to said joint, each of said tabs being configured for reception in a respective one of said slots for securing said cover only at said first end against longitudinal shifting relative to the roof with said second end being free of said tabs.

10. The apparatus as set forth in claim 9, further including longitudinally aligned, first and second ones of said covers with said second end of said first cover overlapping said first end of said second cover for presenting said covers in an overlapping relationship.

11. The apparatus as set forth in claim 10, each of said covers including a pair of cover flanges extending inwardly from said respective side wall interior surfaces with each of said cover flanges presenting an upper face, said apparatus further including first and second ones of said batten clips receiving said tabs of said first and second covers respectively, said clip ends each including structure for engaging said upper faces of said cover flanges respectively for restraining said covers against upward shifting so that said second clip restrains said first cover in said overlapping relationship.

* * * * *